US006233889B1

(12) United States Patent
Hulsey

(10) Patent No.: US 6,233,889 B1
(45) Date of Patent: May 22, 2001

(54) VENTILATED ROOF MEMBRANE PLATE AND METHOD OF INSTALLING MEMBRANE ROOF UTILIZING SAME

(75) Inventor: Tommy Ray Hulsey, Sulphur Springs, TX (US)

(73) Assignee: Construction Fasteners, Inc., Wyomissing, PA (US)

( * ) Notice: Subject to any disclaimer, the term of this patent is extended or adjusted under 35 U.S.C. 154(b) by 0 days.

(21) Appl. No.: 09/549,250

(22) Filed: Apr. 14, 2000

(51) Int. Cl.[7] ..... E04B 1/70; E04F 17/00; E04F 17/04; E04F 17/08

(52) U.S. Cl. ..... 52/302.1; 52/302.1; 52/302.6; 411/533

(58) Field of Search ..... 52/302.1, 302.6, 52/198, 410; 285/46; 411/533; 428/40

(56) References Cited

U.S. PATENT DOCUMENTS

| | | | | |
|---|---|---|---|---|
| 4,282,050 | | 8/1981 | Thiis-Evensen | 156/71 |
| 4,543,763 | | 10/1985 | Ernst et al. | 52/698 |
| 4,641,471 | | 2/1987 | Young et al. | 52/361 |
| 4,747,241 | | 5/1988 | Whitman | 52/173 R |
| 4,945,699 | | 8/1990 | Murphy | 52/410 |
| 4,987,714 | * | 1/1991 | Lemke | 52/410 |
| 5,035,028 | | 7/1991 | Lemke | 24/336 |
| 5,069,589 | | 12/1991 | Lemke | 411/533 |
| 5,082,412 | * | 1/1992 | Thomas | 411/533 |
| 5,204,148 | * | 4/1993 | Alexander | 428/40 |
| 6,004,645 | | 12/1999 | Hubbard | 428/57 |

* cited by examiner

*Primary Examiner*—Carl D. Friedman
*Assistant Examiner*—Chi Nguyen
(74) *Attorney, Agent, or Firm*—Caesar, Rivise, Bernstein, Cohen & Pokotilow, Ltd.

(57) ABSTRACT

A membrane plate for attaching a lower membrane and an adjacent upper membrane overlapping the lower membrane to a roof is provided where the membrane plate includes a plate body having a top surface and a bottom surface, the top surface adapted to seat against the upper membrane, the bottom surface adapted to seat against the lower membrane, the top surface and the bottom surface separated by at least one wall generally perpendicular to the top surface and the bottom surface, the plate body having a generally centrally located aperture to permit a fastening device to pass through for securing the membrane plate and the membrane to the roof The membrane plate further includes holes in the plate body at least partially located in the generally perpendicular wall to permit air to flow between the top surface to bottom surface of the plate, whereby the holes permits a bubble of air created during the securing of the upper membrane to the lower membranes to the roof by an adhesive, to dissipate through the membrane plate and through the lower membrane via a hole in the lower membrane created by the fastening device.

8 Claims, 3 Drawing Sheets

VENTILATED ROOF MEMBRANE PLATE AND METHOD OF INSTALLING MEMBRANE ROOF UTILIZING SAME

BACKGROUND OF THE INVENTION

This invention relates generally to membrane plates, and, more particularly, to a membrane plate for attaching a membrane to a roof.

A roofing system generally includes a roof deck which is considered the structural supporting surface of a building extending between the surrounding exterior walls of the building.

The roof deck may be constructed from plywood, metal decking or concrete or any other suitable material. Depending upon the construction, the roof deck may extend over the surrounding exterior walls or the roof deck may stop short of the exterior walls thereby forming a parapet wall, i.e., a low retaining wall at the edge of the roof deck. If desired, the roofing system may also include an insulation barrier formed from any suitable material applied over the roof deck.

To make the roof deck and building weather resistant, a single-ply membrane roof is typically installed over the roof deck. The single ply membrane roof refers to a water impermeable single sheet of polymeric material such as ethylene propylene diene rubber (EPDM) having an adhesive thereon. The membrane roof has heretofore been installed on the roof deck using a variety of different methods.

For example, the interior of the membrane roof may be held to the roof deck by the use of ballast and/or penetrating or non-penetrating fastener means as known in the art. An example of a penetrating fastener means for retaining the membrane roof installed to a roof deck is by utilizing membrane plates in the form of a plurality of small, circular metal plates having a hole in the center and a roofing screw or other suitable fastener. In order to anchor the membrane roof, the membrane plates are spaced apart in rows on the membrane roof and the fastener is driven through the hole in each plate, the membrane roof, any insulation material, and then into the roof deck. The metal plates are covered by overlapping roof membrane and joined together with an adhesive. Other stress plates used in the past include long, straight bars with holes in the bar. In the past, most adhesives have been painted on.

During the course of assembly of the components, air is trapped on top of the plate and prevented from escape by virtue of the aggressive tack of the adhesive. Once the adhesive contacts another material, it bonds securely. Repositioning by breaking the adhesive or lifting the upper membrane to allow air to escape is virtually impossible. The resulting air bubble is trapped. Over time (months or years), the expansion and contraction of the bubble will compromise the sealing ability of the seam.

It is well known for a stress plate to be formed in a circular shape. For example, U.S. Pat. No. 4,787,188 (Murphy) teaches a circular stress plate. The stress plate taught by Murphy has an outer circular rib and an inner circular rib as well as a plurality of hinged prongs. The hinged prongs are disposed at equal radial distances from the center of the stress plate and circumferentially spaced apart from each other at angles of ninety degrees.

U.S. Pat. No. 6,004,645 (Hubbard) teaches a method of applying a roof membrane assembly to a roof deck with overlapping membranes utilizing an adhesive and fasteners. No provision is made for release of air bubbles.

U.S. Pat. No. 4,282,050 (Thiis-Evensen) teaches a stress plate for cladding a roof on a support structure. The fastening process taught includes applying an insulation layer on the support structure and applying edge abutting webs of cladding material over the insulation layer. The insulation layer and the cladding layers are simultaneously mechanically anchored to the support structure using fasteners. The edges of the webs and the fasteners are sealed by welding strips. The fastener taught by Thiis-Evensen for fastening the layers to the support structure is rectangular in shape with gripping claws disposed at each end of the plate.

U.S. Pat. No. 4,543,763 (Ernst) teaches a fastening plate having circumferentially spaced apart projections disposed on the plate. The plates taught by Ernst can be round or square and are adapted to control the rate of axial penetration of an anchor in masonry structure.

OBJECTS OF THE INVENTION

Accordingly, it is a general object of the present invention to provide a stress plate for a membrane roof which overcomes the disadvantages of the prior art.

It is a further object of the present invention to provide a stress plate for a membrane roof that is inexpensive.

It is still a further object of the present invention to provide a stress plate for a membrane roof that has improved durability over a wide range of climatic conditions, including rain.

It is yet another object of the present invention to provide a stress plate for a membrane roof that has improved resistance to uplift forces by wind and other causes, over a long period of time.

It is still another object of the present invention to provide a stress plate for a membrane roof a stress plate for a membrane roof that is simple and economical.

It is still another object of the present invention to provide a stress plate for a membrane roof a stress plate for a membrane roof that provides means for removal of air bubbles adjacent membrane fasteners to provide longer life of the membrane roof.

SUMMARY OF THE INVENTION

These and other objects of this invention are achieved by providing a membrane plate for attaching a lower membrane and an adjacent upper membrane overlapping the lower membrane to a roof where the membrane plate includes a plate body having a top surface and a bottom surface, the top surface adapted to seat against the upper membrane, the bottom surface adapted to seat against the lower membrane, the top surface and the bottom surface separated by at least one wall generally perpendicular to the top surface and the bottom surface, the plate body having a generally centrally located aperture to permit a fastening device to pass through for securing the membrane plate and the membrane to the roof. The membrane plate further includes holes in the plate body at least partially located in the generally perpendicular wall to permit air to flow between the top surface to bottom surface of the plate, whereby the holes permits a bubble of air created during the securing of the upper membrane to the lower membranes to the roof by an adhesive, to dissipate through the membrane plate and through the lower membrane via a hole in the lower membrane created by the fastening device.

A method of installing a membrane on a roof deck is also provided which includes the steps of laying a lower membrane on a roof deck, providing a plurality of ventilated membrane plates as described above for attaching the lower membrane to the roof deck along at least one edge, securing the lower membrane to the roof deck by driving a fastener through the aperture in each of the plurality of ventilated membrane plates, laying an adhesive in a continuous sheet over the lower membrane and adjacent the at least one edge, adhering an upper membrane on the roof, overlapping the lower membrane along the adhesive, and applying pressure to the upper membrane at a point adjacent each ventilated membrane plate to squeeze out a bubble of air formed between the lower membrane and the adhesive.

DESCRIPTION OF THE DRAWINGS

Other objects and many attendant features of this invention will become readily appreciated as the same becomes better understood by reference to the following detailed description when considered in connection with the accompanying drawings, wherein.

DETAILED DESCRIPTION OF THE PREFERRED EMBODIMENT

Figure 1:
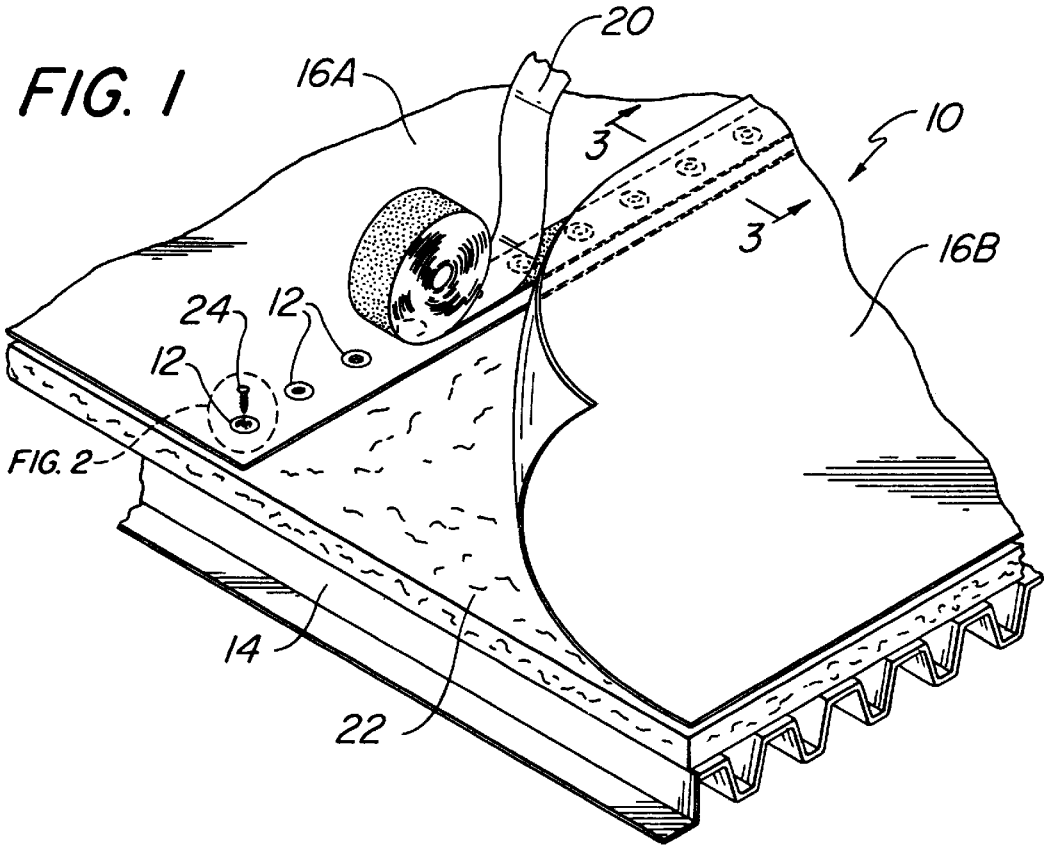
FIG. 1 is an isometric view of a roof membrane assembly having membrane stress plates in accordance with one preferred embodiment of the present invention.
Figure 2:
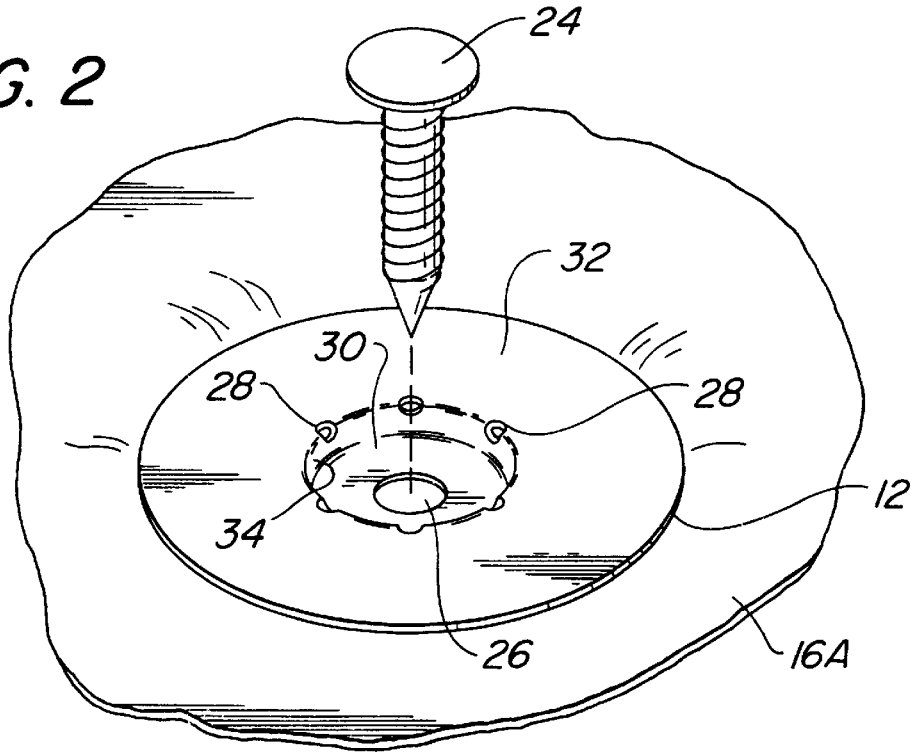
FIG. 2 is an isometric view of a detail view of a membrane stress plate and fastener in accordance with FIG. 1.

Referring now to the various figures of the drawing where like reference numbers refer to like parts throughout the several views, there is shown in FIG. 1, a roof membrane assembly 10 which utilizes a ventilated membrane plate 12 as mounted on a roof deck 14, in accordance with one preferred embodiment of the present invention. As can be seen in FIG. 1, the roof membrane assembly 10 attaches to a roof deck 14 and comprises at least a lower roof membrane sheet 16A and an upper overlapping roof membrane sheet 16B, adhesive, preferably in the form of double sided adhesive tape 18 having release paper 20 at least over one surface thereof. Optionally, one or more layers of roof insulation 22 may be disposed between the roof deck and the roof membrane sheets 16A and 16B. In a typical installation, as shown in FIG. 1, insulation 22 is laid on top of a roof deck 14 and overlapping roof membrane sheets 16A and 16B are spread over the entire roof deck to be covered. The overlapping portions of the roof membrane sheets 16A and 16B must be secured to one another to create a windproof and rainproof seal.

After the lower membrane sheet 16A is laid down on the roof deck 14, a plurality of generally evenly spaced ventilated membrane plates 12 are installed adjacent the edges of the lower roof membrane sheet 16A as shown in FIG. 1. Each ventilated membrane plate 12 is preferably about two inches in diameter and secured by a fastener such as a roofing screw 24 through the membrane plate 12, through the optional insulation layer 22 and into the roof deck. Preferably a strip of double-sided, rubber-like adhesive tape 18 is placed along the edge of the lower roof membrane sheet 16A covering the row of ventilated membrane plates 12 and roofing screw 24 on each edge. The adhesive tape is preferably an uncured rubber type adhesive that utilizes heat from the sun to assist in curing and bonding to layers of membrane sheet 16A and 16B above and below the tape. The adhesive tape 18 is preferably manufactured with a strip of release paper 20 over the adhesive to facilitate its handling and placement. The width of the tape is preferably approximately six inches wide and overlaps the metal plate approximately two inches at the sides of each ventilated membrane plate 12. An adjacent and overlapping upper roof membrane sheet 16B is placed in such a manner that its edge overlaps the previously applied adhesive tape forming a water-tight seam, sealing against the weather and protecting the fastener 24, ventilated membrane plate 12, and tape 18 from exposure to the elements.

During the course of assembly of the components, air is typically trapped on top of the prior art membrane plates and prevented from escape by virtue of the aggressive tack of the adhesive. Once the adhesive contacts another material, it bonds securely. Repositioning of the tape or lifting to allow air to escape is virtually impossible. The resulting air bubble is trapped. Over time, typically months or years, the expansion and contraction of the bubble will compromise the sealing ability of the seam.

The present invention solves this problem by providing ventilated membrane plates 12 where the presence and location of a plurality of holes 28 radially displaced from the center of each ventilated membrane plate 12 and preferably located axially on the edge of the radius of intersection of the horizontal plane of the plate 12 and the vertical wall 34 of a central recess 30 of the membrane plate 12.

Figure 3:
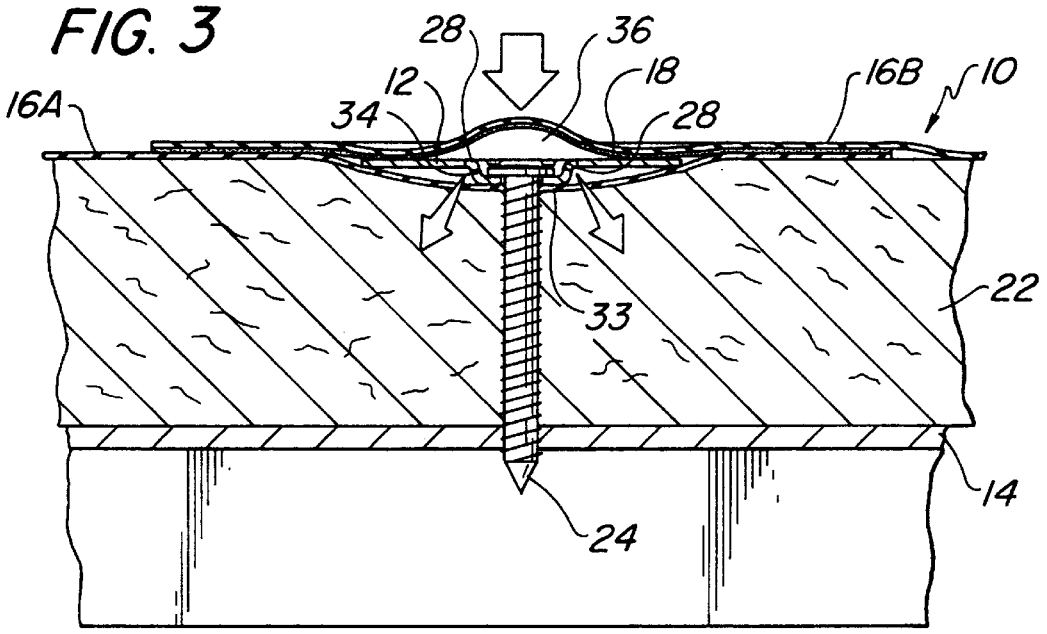
FIG. 3 is an enlarged, cross-sectional side view of a membrane-type roof having the stress plate in accordance with FIG. 1, shown during the roof installation process.

In use, the lower membrane sheet 16A is laid down and the ventilated membrane plates 12 are placed on edges of the lower membrane sheet 16A at generally equal increments where an adjacent upper membrane sheet 16B is to be laid. The membrane plates 12 are secured to the roof deck 14 by roofing screws 24 through a center clearance aperture 26 in the membrane plates 12. A layer of double sided adhesive tape 18 is rolled along the edge of the lower membrane sheet 16A over the installed membrane plates 12. The release paper 20 over the second side of the adhesive tape 18 is removed and the upper overlapping membrane sheet 16B is laid over the lower membrane sheet 16A where the adhesive tape 18 has been laid. As can be seen in FIG. 3, typically, a bubble of air 36 forms between the upper membrane sheet 16B with the adhesive tape 18 thereon and the ventilated membrane plate 12. In prior art membrane plates, this bubble of air could not easily be removed because the bubble was fully sealed between the surface of the lower membrane sheet 16A and the upper membrane sheet 16B having the adhesive tape 18 thereon.

The

A unique aspect of the present invention is the construction of the ventilated membrane plate 12. The membrane plate 12 has the central recess 30 and the plurality of ventilation holes 28 radially displaced from the center of the ventilated membrane plate 12 and located axially on the edge of the radius of intersection of the horizontal plane or top surface 32 of the membrane plate 12 and the vertical wall 34 of the central recess 30.

Figure 4:
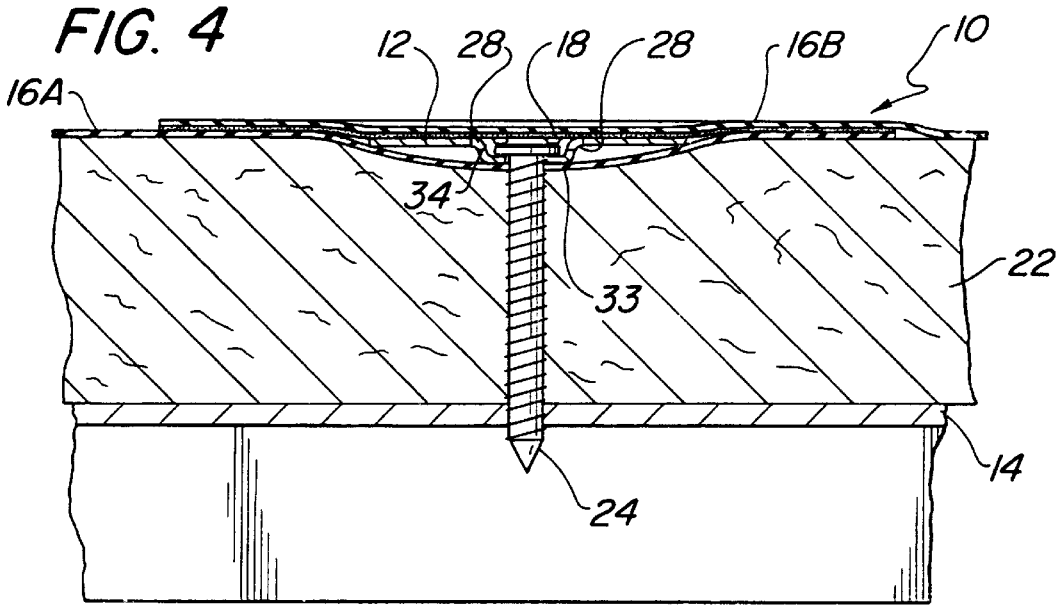
FIG. 4 is an enlarged, cross-sectional side view of the membrane-type roof of FIG. 3, shown subsequent to the roof installation.

The membrane plate 12 of the present invention provides a flat top face that is a horizontal plane, top surface 32 which is substantially coplanar with the upper membrane sheet 16B and restricting the amount of air that is possible to become trapped by the adhesive tape. The only air that can be trapped is in the immediate vicinity of the central recess 30. The holes 28 are located on the plate in such a manner that the tape cannot cover the entire hole and thereby allows the remaining small bubble of air to be forced out through the roof deck by light finger pressure on top of the adhesive. See FIGS. 3 and 4. Any air forced out in this manner exits the lower membrane 16B through a hole in the lower membrane 16B created by the roofing screw 24.

Figure 5:
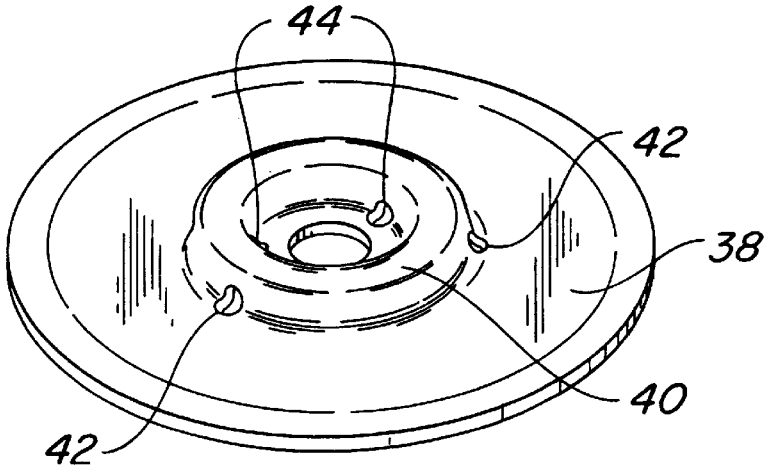
FIG. 5 is an isometric view of an alternate embodiment of a membrane stress plate in accordance with a preferred embodiment of the present invention.
Figure 6:
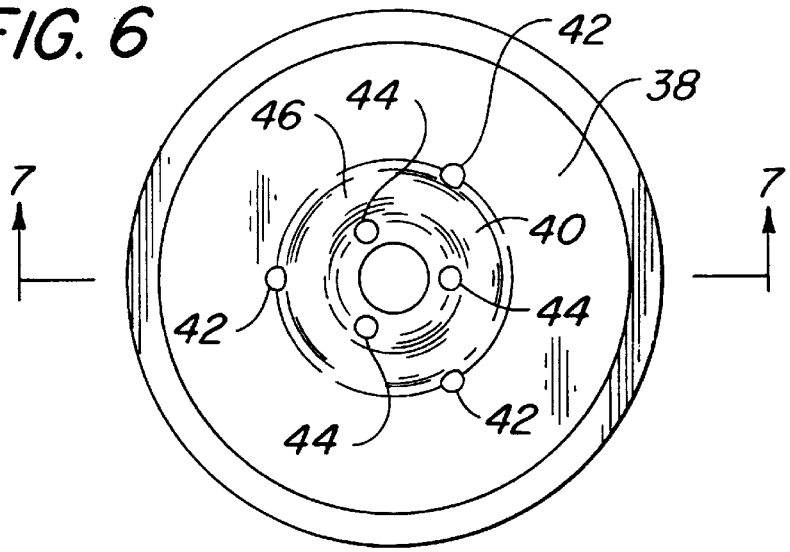
FIG. 6 is a top, plan view of the alternate embodiment of the membrane stress plate of FIG. 5.
Figure 7:
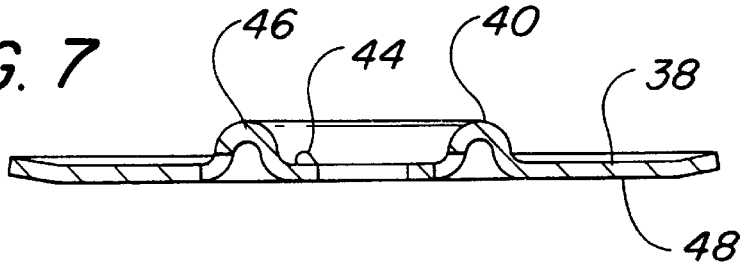
FIG. 7 is a cross-sectional side view of the alternate embodiment of the membrane stress plate of FIG. 5, taken substantially along lines 7—7 of FIG. 6.

An alternate embodiment of a membrane plate 38 is depicted in FIGS. 5–7. Here, a circular rib 40 is formed into the membrane plate 38 that projects generally vertically upward from the membrane plate 38. The membrane plate therefore has top surface 46 and bottom surface Outer ventilation holes 42 and inner ventilation holes 44 are formed into the rib 40 at generally equal increments which function in a similar manner to the ventilation holes 28 of the first embodiment membrane plate 38. Again, since the holes 42, 44 are located on a recessed area not touched by the adhesive tape, air may move through the membrane plate 38 in a similar manner to that of the first embodiment. This particular embodiment is optimized in design to sink into generally soft insulation board (not shown) or like, relatively soft materials. Otherwise, this embodiment of the vent plate 38 performs substantially the same way as that of the first embodiment.

Without further elaboration, the foregoing will so fully illustrate our invention that others may, by applying current or future knowledge, readily adopt the same for use under various conditions of service.

I claim:

1. A membrane plate for attaching a lower membrane and an adjacent upper membrane overlapping said lower membrane, to a roof, said membrane plate comprising:

(a) a plate body having a top surface and a bottom surface, said top surface adapted to seat against said upper membrane, said bottom surface adapted to seat against said lower membrane, said top surface and said bottom surface separated by at least one wall generally perpendicular to said top surface and said bottom surface, said plate body having a generally centrally located aperture to permit a fastening device to pass therethrough for securing said membrane plate and said membrane to said roof; and (b) a plurality of holes in said plate body at least partially located in said generally perpendicular wall to permit air to flow between said top surface to bottom surface of said plate;

whereby said plurality of holes permits a bubble of air created during the securing of said upper membrane to said lower membranes to said roof by an adhesive, to dissipate through said membrane plate and through the lower membrane via a hole in said lower membrane created by said fastening device.

2. The membrane plate for attaching a membrane to a roof of claim 1, wherein said plate body has generally flat top and bottom surfaces.

3. The membrane plate for attaching a membrane to a roof of claim 1, wherein said plate body has a central recess created by said wall and said top surface, said wall being cylindrically shaped, said cylindrical wall being coaxial with said aperture.

4. The membrane plate for attaching a membrane to a roof of claim 1, wherein said central coaxial recess is formed by a circular rib formed by at least partially by said wall and a top surface, surrounding said centrally located aperture.

5. The membrane plate for attaching a membrane to a roof of claim 1, wherein said generally centrally located aperture to permit a fastening device to pass therethrough is an aperture to permit a roofing nail to pass therethrough.

6. A method of installing a membrane on a roof deck, comprising the steps of:

(a) laying a lower membrane on a roof deck;

(b) providing a plurality of ventilated membrane plates for attaching the lower membrane to the roof deck along at least one edge thereof, said ventilated membrane plates comprising:

(i) a plate body having a top surface and a bottom surface, said top surface adapted to seat against an upper membrane, said bottom surface adapted to seat against said lower membrane, said top surface and said bottom surface separated by at least one wall generally perpendicular to said top surface and said bottom surface, said plate body having a generally centrally located aperture to permit a fastening device to pass therethrough for securing said membrane plate and said membrane to said roof, and (ii) a plurality of holes in said plate body at least partially located in said generally perpendicular wall to permit air to flow between said top surface to bottom surface of said plate;

(c) securing said lower membrane to said roof deck by driving a fastener through said aperture in each of said plurality of ventilated membrane plates;

(d) laying an adhesive in a continuous sheet over said lower membrane and adjacent said at least one edge;

(e) adhering an upper membrane on said roof, overlapping said lower membrane along said adhesive; and (f) applying pressure to said upper membrane at a point adjacent each ventilated membrane plate to squeeze out a bubble of air formed between said lower membrane and said adhesive.

7. The method of installing a membrane on a roof deck of claim 6 wherein the step of laying an adhesive includes providing said adhesive as a roll of double sided tape.

8. The method of installing a membrane on a roof deck of claim 6 including a step of applying at least one insulation layer between said roof deck and said lower and upper membranes.

* * * * *